US010753113B2

(12) United States Patent
Lin et al.

(10) Patent No.: US 10,753,113 B2
(45) Date of Patent: Aug. 25, 2020

(54) AUTOMATIC PARKING SYSTEM WITH TRANSVERSE ARRANGEMENT

(71) Applicant: Guangdong Weichuang Wuyang Intelligent Equipment Co., Ltd., Dongguan (CN)

(72) Inventors: Weitong Lin, Dongguan (CN); Yungao Hu, Dongguan (CN); Yongjin Guo, Dongguan (CN); Pin Cao, Dongguan (CN)

(73) Assignee: GUANGDONG WEICHUANG WUYANG INTELLIGENT EQUIPMENT CO., LTD., Dongguan (CN)

( * ) Notice: Subject to any disclaimer, the term of this patent is extended or adjusted under 35 U.S.C. 154(b) by 36 days.

(21) Appl. No.: 16/165,744

(22) Filed: Oct. 19, 2018

(65) Prior Publication Data

US 2019/0055746 A1 Feb. 21, 2019

(30) Foreign Application Priority Data

Feb. 1, 2018 (CN) ..... 2018 1 0103437

(51) Int. Cl.
*E04H 6/22* (2006.01)
*E04H 6/20* (2006.01)

(52) U.S. Cl.
CPC ..... *E04H 6/22* (2013.01); *E04H 6/20* (2013.01)

(58) Field of Classification Search
CPC .... E04H 6/18; E04H 6/20; E04H 6/22; E04H 6/245; E04H 6/282; B65G 1/0414; B65G 1/0492; B65G 1/1378; B65G 1/137; B65G 1/1373; B65G 1/06; B65G 1/0435; B66B 9/10; B66B 9/003; B66B 11/008; B66B 7/068; B66B 7/062; B66B 7/066
USPC ..... 414/252, 253, 266
See application file for complete search history.

(56) References Cited

U.S. PATENT DOCUMENTS 1,468,147 A * 9/1923 Melvon ..... E04H 6/282 414/258
3,042,228 A * 7/1962 Frangos ..... E04H 6/22 414/234
4,459,078 A * 7/1984 Chiantella ..... B65G 1/0414 414/279
5,893,696 A * 4/1999 Belinsky ..... E04H 6/225 414/253

(Continued)

*Primary Examiner* — Glenn F Myers
(74) *Attorney, Agent, or Firm* — Shimokaji IP

(57) ABSTRACT

An automatic parking system with transverse arrangement includes at least two parking levels, a lifting tunnel, a gateway, at least two carrying devices, and a lifting device; each parking level includes a transverse passage and a transverse row of parking spaces connected to at least one side of the transverse passage; the lifting tunnel is connected to at least one of two ends of the transverse passages of the at least two parking levels; the gateway is formed in an outer side of the lifting tunnel; each carrying device includes a carrying frame and a transverse moving mechanism adapted for driving the carrying device to move along the transverse passage; the lifting device is disposed in the lifting tunnel for conveying the carrying device to a height corresponding to any of the parking levels so as to make the carrying device capable of moving to the corresponding transverse passage.

9 Claims, 7 Drawing Sheets

(56) References Cited

U.S. PATENT DOCUMENTS

| | | | | |
|---|---|---|---|---|
| 2008/0247848 | A1* | 10/2008 | Freudelsperger .... | B65G 1/0492<br>414/277 |
| 2011/0182703 | A1* | 7/2011 | Alan ..... | E04H 6/183<br>414/231 |
| 2014/0023462 | A1* | 1/2014 | Lalesse ..... | B65G 1/0407<br>414/277 |

* cited by examiner

AUTOMATIC PARKING SYSTEM WITH TRANSVERSE ARRANGEMENT

CROSS-REFERENCE TO RELATED APPLICATIONS

This application claims the benefit of priority to Chinese patent application No. 201810103437.6, filed on Feb. 1, 2018, which is hereby incorporated by reference in its entirety.

FIELD OF THE INVENTION

The present invention relates to an automatic parking system, and more particularly to an automatic parking system with transverse arrangement.

BACKGROUND OF THE INVENTION

At present, an automatic parking system with horizontally movable loading boards includes an automatic parking system with longitudinally arranged parking spaces and an automatic parking system with transversely arranged parking spaces. Most of the automatic parking systems with horizontally movable loading boards have parking spaces longitudinally arranged. In some cases, the parking spaces of some of the automatic parking systems with horizontally movable loading boards have to transversely arranged, because of topography and other reasons. However, when one carrying device of the current automatic parking system with transversely arranged parking spaces malfunctions, which will cause a corresponding parking level where the carrying device is located cannot execute the parking work. Besides, when a user uses this parking system, he may back the vehicle into the automatic parking system from the gateway when parking and drive forward when unparking, or may drive forward into the automatic parking system from the gateway when parking and back the vehicle when unparking, thus it is very inconvenient. Moreover, due to the limited space of the automatic parking system, the user is required to have higher parking technology.

Therefore, there is a need for providing an improved automatic parking system which has good fault tolerance, high parking and unparking efficiency and a very simple operation when the user parks or unparks the vehicle at the gateway.

SUMMARY OF THE INVENTION

One objective of the present invention is to provide an automatic parking system with transverse arrangement which has good fault tolerance, high parking and unparking efficiency and a very simple operation when the user parks or unparks a vehicle at the gateway.

To achieve the above-mentioned objective, an automatic parking system with transverse arrangement includes at least two parking levels, a lifting tunnel, a gateway, at least two carrying devices for carrying the vehicle, and a lifting device; each parking level includes a transverse passage and a transverse row of parking spaces connected to at least one side of the transverse passage; the lifting tunnel is connected to at least one of two ends of the transverse passages of the at least two parking levels; the gateway is formed in an outer side of the lifting tunnel; each carrying device includes a carrying frame and a transverse moving mechanism adapted for driving the carrying device to move along the transverse passage; the lifting device is disposed in the lifting tunnel for conveying the carrying device to a height corresponding to any of the parking levels.

Preferably, the two ends of the transverse passages of the at least two parking levels are connected with two lifting tunnels, respectively; and two gateways are formed in the outer sides of the two lifting tunnels, respectively.

Preferably, the carrying device further includes a longitudinal pickup mechanism for moving a loading board configured to support a vehicle thereon between the corresponding parking spaces and the carrying frame.

Preferably, the automatic parking system further includes a rotating and jacking assembly disposed on a lifting platform of the lifting device, the rotating and jacking assembly is configured to be connected with a bottom of the loading board so as to make the loading board rotate and move up and down.

Preferably, the rotating and jacking assembly includes a jacking mechanism, a rotating mechanism and a jacking frame, the jacking frame is configured to support the loading board thereon, the jacking mechanism is connected with the jacking frame so as to make the jacking frame move up and down, and the rotating mechanism is connected with the jacking frame for making the jacking frame rotate.

Preferably, the jacking mechanism includes a first motor, a first driving wheel connected with an output end of the first motor, a first driven wheel connected with the first driving wheel by a first chain, a pulling wheel disposed coaxially with the first driven wheel, a transmission wheel disposed above the pulling wheel, and a second chain disposed on the pulling wheel and the transmission wheel, the transmission wheel and the pulling wheel are staggered and tangent in a vertical direction, the second chain is extended vertically upwards from the pulling wheel and then is disposed on the transmission wheel, a distal end of the second chain extended vertically downwards from the transmission wheel is connected with the jacking frame for making the jacking frame move up and down.

Preferably, the rotating mechanism includes a second motor and a horizontally rotating wheel connected with an output end of the second motor, the horizontally rotating wheel is capable of being driven by the second motor so as to drive the jacking frame to rotate.

Preferably, the longitudinal pickup mechanism includes two chain transmission devices disposed at two opposite sides of the carrying frame, respectively, and a locking element with two ends thereof fixed to the two chain transmission devices, respectively, the loading board has a locking portion for engaging with the locking element disposed thereon, the locking portion and the locking element are configured to engage with each other so as to make the loading board be locked with the longitudinal pickup mechanism, the locking portion is a hook plate, the locking element is a hanging rod, the hanging rod is driven by the two chain transmission devices so as to make the hook plate move together, each chain transmission device includes a third motor, a second driving wheel, a second driven wheel assembly and a third chain, an output end of the third motor is connected with the second driving wheel, the second driving wheel is connected with the second driven wheel assembly by the third chain so as to drive the loading board locked with the hanging rod.

Preferably, the carrying device further includes a micro-motion mechanism disposed on the carrying frame, the micro-motion mechanism includes a fourth motor, a third driving wheel connected with an output end of the fourth motor, a third driven wheel connected with the third driving wheel by a fourth chain, a gear disposed coaxially with the third driven wheel, and a rack longitudinally fixed on the longitudinal pickup mechanism and engaging with the gear.

Preferably, the transverse moving mechanism includes a transverse driving motor, a driving rod connected with an output end of the transverse driving motor, and two transverse moving wheels disposed on two ends of the driving rod, the transverse driving motor drives the driving rod to rotate so as to make the two transverse moving wheels roll.

In comparison with the prior art, the automatic parking system with transverse arrangement of the present invention uses the lifting device to drive the carrying device to move up and down, the transverse moving mechanism of the carrying device is configured to drive the carrying device to move back and forth in any transverse passage of the automatic parking system with transverse arrangement, therefore, the carrying device of the present invention can store or get the vehicle at different parking levels, then has good fault tolerance, high flexibility and high efficiency. Moreover, the two ends of all transverse passages are connected with the respective lifting tunnels, the two lifting tunnels form two gateways, respectively, then the vehicle can be driven forward into the automatic parking system from one of the gateways and be driven forward out of the automatic parking system from the other of the gateways. It does not require the user back the vehicle, therefore the user can park and unpack the vehicle convenient and fast, the problems caused by driving technology or other reasons are greatly reduced. In addition, the rotating and jacking assembly can turn the vehicle around, therefore, the automatic parking system can make the user do not need to back the vehicle by just one lifting tunnel with the gateway.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
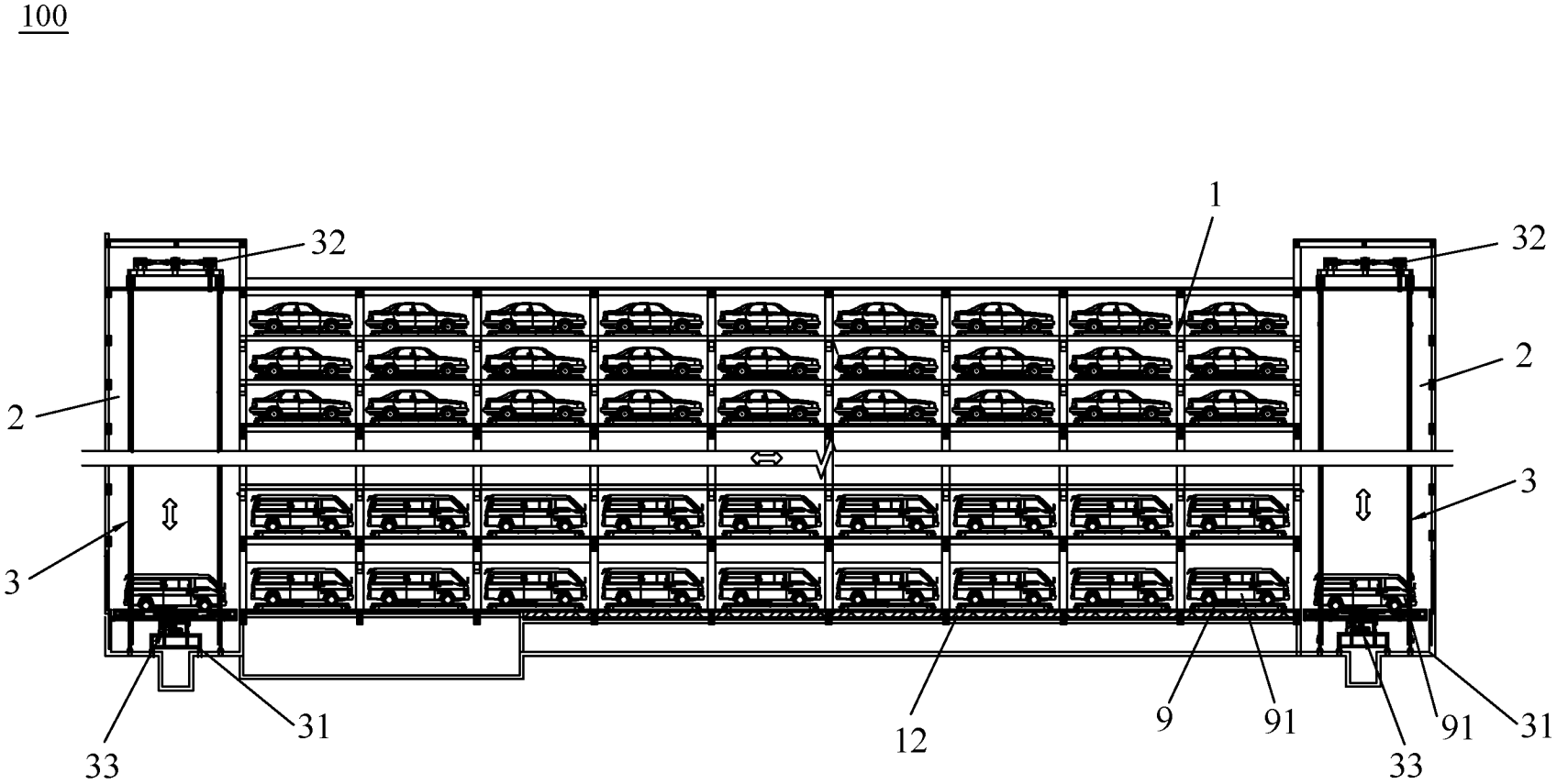
FIG. 1 is a front perspective view of an automatic parking system with transverse arrangement according to an embodiment of the present invention.

A distinct and full description of the technical solution of the present invention will follow by combining with the accompanying drawings.

Referring to FIGS. 1-7, an automatic parking system with transverse arrangement 100 according to an embodiment of the present invention includes at least two parking levels 1, a lifting tunnel 2, a gateway 4, at least two carrying devices 5 for carrying vehicles 91 and a lifting device 3. Each parking level 1 includes a transverse passage 11 and a transverse row of parking spaces 12 connected to at least one side of the transverse passage 11. The lifting tunnel 2 is connected to at least one of two ends of the transverse passages 11 of the at least two parking levels 1. The gateway 4 is formed in an outer side of the lifting tunnel 2. Each carrying device 5 includes a carrying frame 51 and a transverse moving mechanism 52 adapted for driving the carrying device 5 to move along the transverse passage 11. The lifting device 3 is disposed in the lifting tunnel 2 for conveying the carrying device 5 to a height corresponding to any of the parking levels 1 so as to make the carrying device 5 capable of moving to the corresponding transverse passage 11. In this embodiment, both sides of the transverse passages 11 are connected with two transverse rows of the parking spaces 12, respectively.

Figure 2:
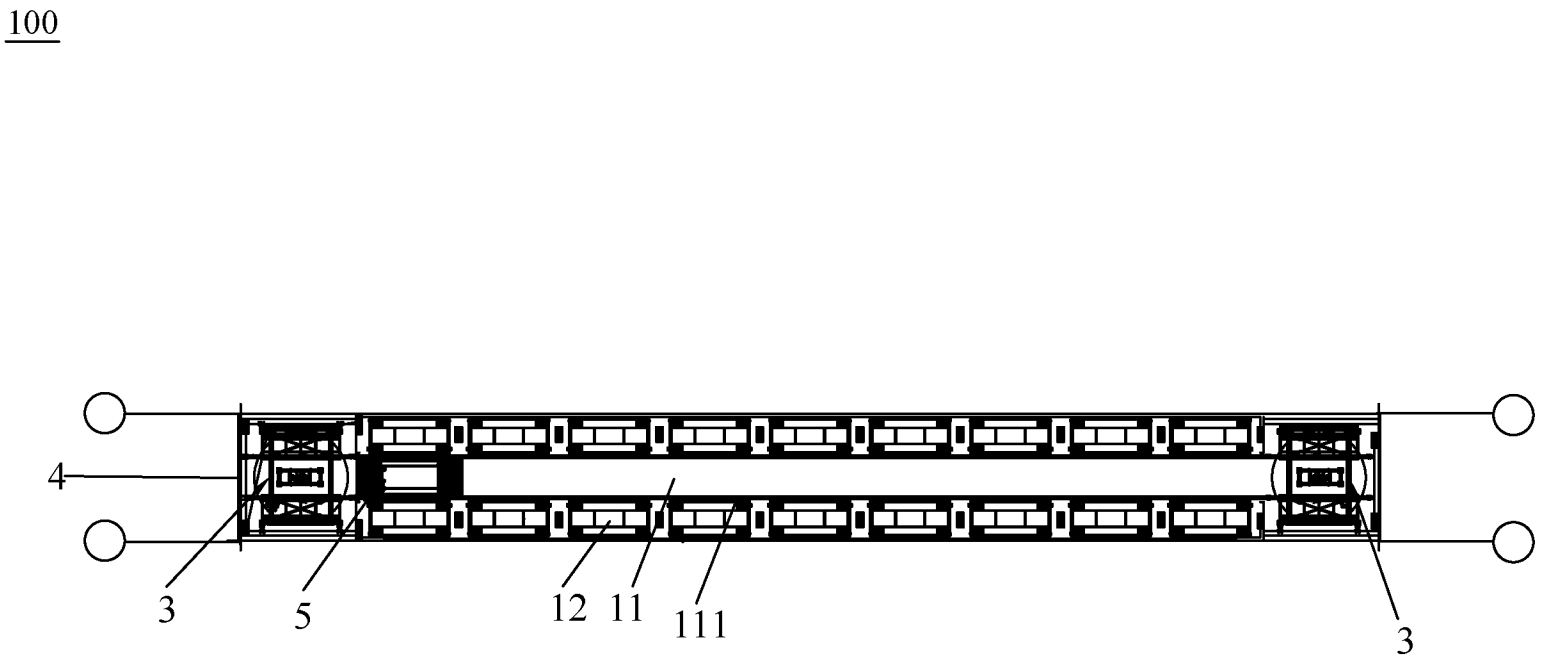
FIG. 2 is a top view of an automatic parking system with transverse arrangement according to an embodiment of the present invention.

As shown in FIGS. 1 and 2, the two ends of the transverse passages 11 of the at least two parking levels 1 are connected with two lifting tunnels 2, respectively; and two gateways 4 are formed in the outer sides of the two lifting tunnels 2, respectively. By disposing two lifting tunnels 2 at the two ends of the transverse passages 11 of the at least two parking levels 1, respectively, and disposing two gateways 4 at the two lifting tunnels 2, respectively, the vehicle 91 can be driven forward into the automatic parking system 100 from one of the gateways 4 and be driven forward out of the automatic parking system 100 from the other of the gateways 4. The user does not need back the vehicle 91, therefore, the user can park and unpack the vehicle 91 convenient and fast, the problems caused by driving technology or other reasons are greatly reduced.

Figure 4:
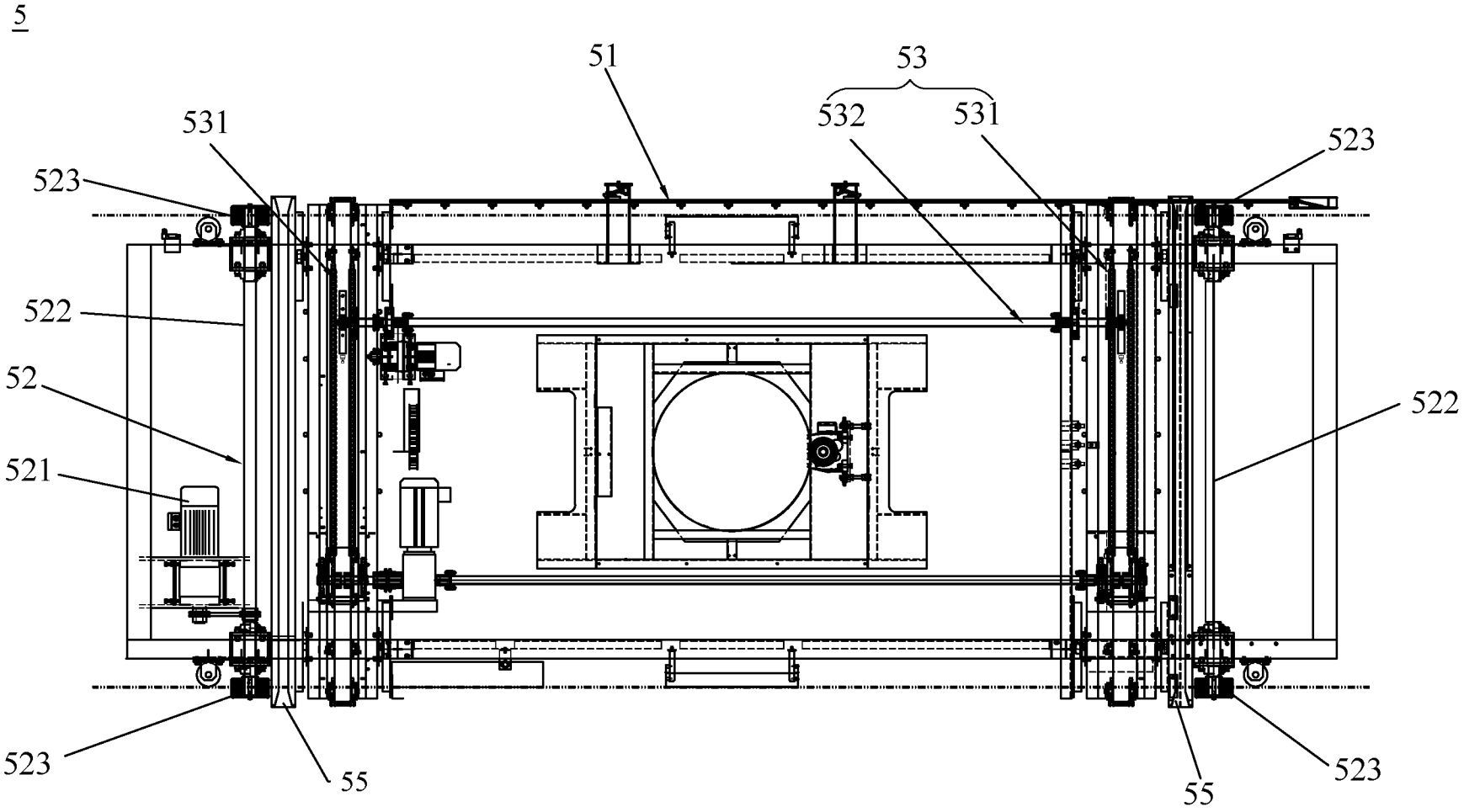
FIG. 4 is a top view of a carrying device according to an embodiment of the present invention.
Figure 5:
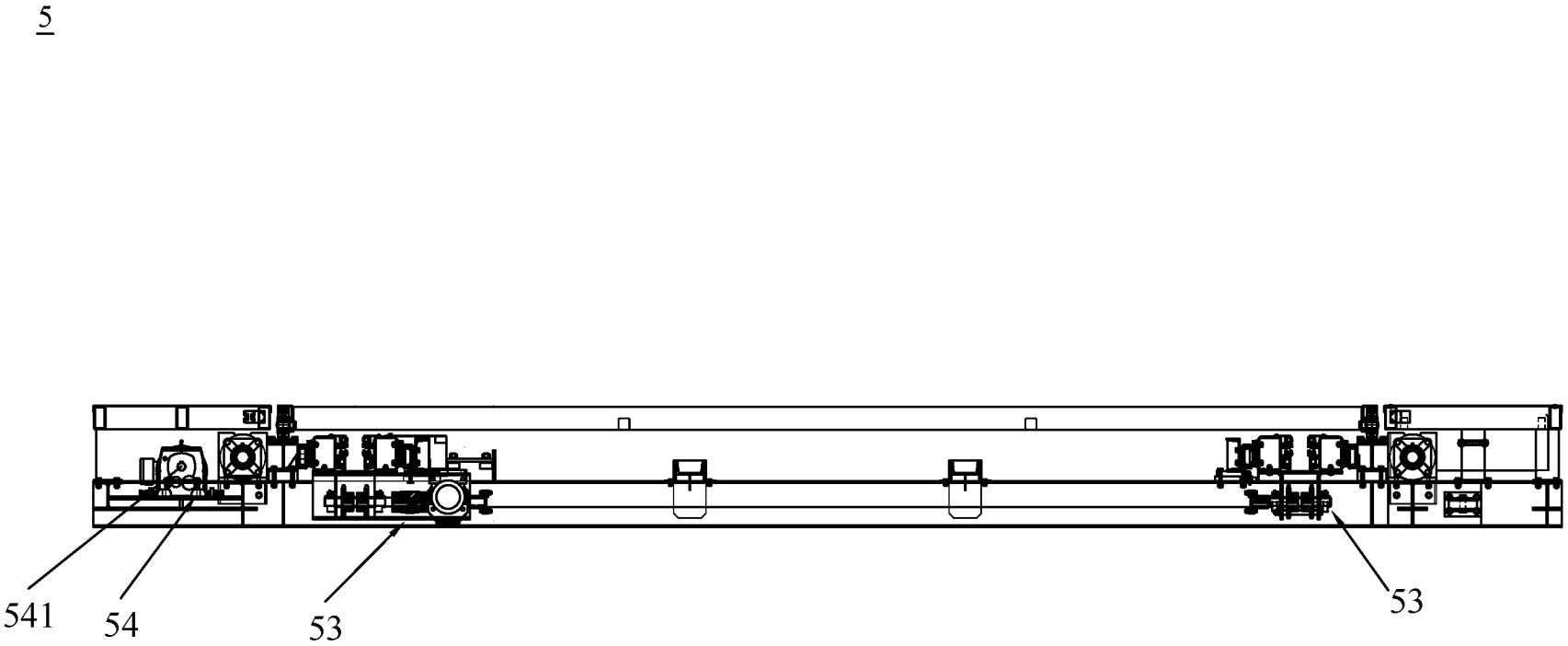
FIG. 5 is a front view of a carrying device according to an embodiment of the present invention.

As shown in FIGS. 1 and 4, in this embodiment, the carrying device 5 supports the vehicle 91 by a loading board 9, the carrying device 5 further includes a longitudinal pickup mechanism 53 for moving the loading board 9 between the corresponding parking spaces 12 and the carrying frame 51.

Referring to FIGS. 1 and 2, the automatic parking system 100 further includes a rotating and jacking assembly 33 disposed on a lifting platform 31 of the lifting device 3, the rotating and jacking assembly 33 is configured to be connected with a bottom of the loading board 9 so as to make the loading board 9 rotate and move up and down. The vehicle 91 can be turned around by the rotating and jacking assembly 33, therefore, only one lifting tunnel 2 with a gateway 4 is required to achieve the effect that the user does not need to back the vehicle 91 when parking or unparking the vehicle 91.

In this embodiment, the lifting device 3 includes a hoisting mechanism 32, a counterweight (not shown), a guiding mechanism (not shown), a leveling mechanism (not shown). The guiding mechanism and the counterweight can make the lifting device 3 move more smoothly and steadily and with less power consumed. By means of the leveling mechanism, the lifting device 3 can be stopped stably at the corresponding position when the vehicle 91 is loaded on the lifting device 3 to cause the change of gravity. In this embodiment, the lifting platform 31 has an anti-collision mechanism (not shown) for preventing friction or collision with the carrying device 5 disposed thereon, and a positioning mechanism (not shown) for monitoring the precise position of the carrying device 5. In addition, in this embodiment, the lifting platform 31 has an automatic door (not shown).

It should be noted that the rotating and jacking assembly 33 may be in various forms. The specific structure of the rotating and jacking assembly 33 in this embodiment will be described below.

Figure 3:
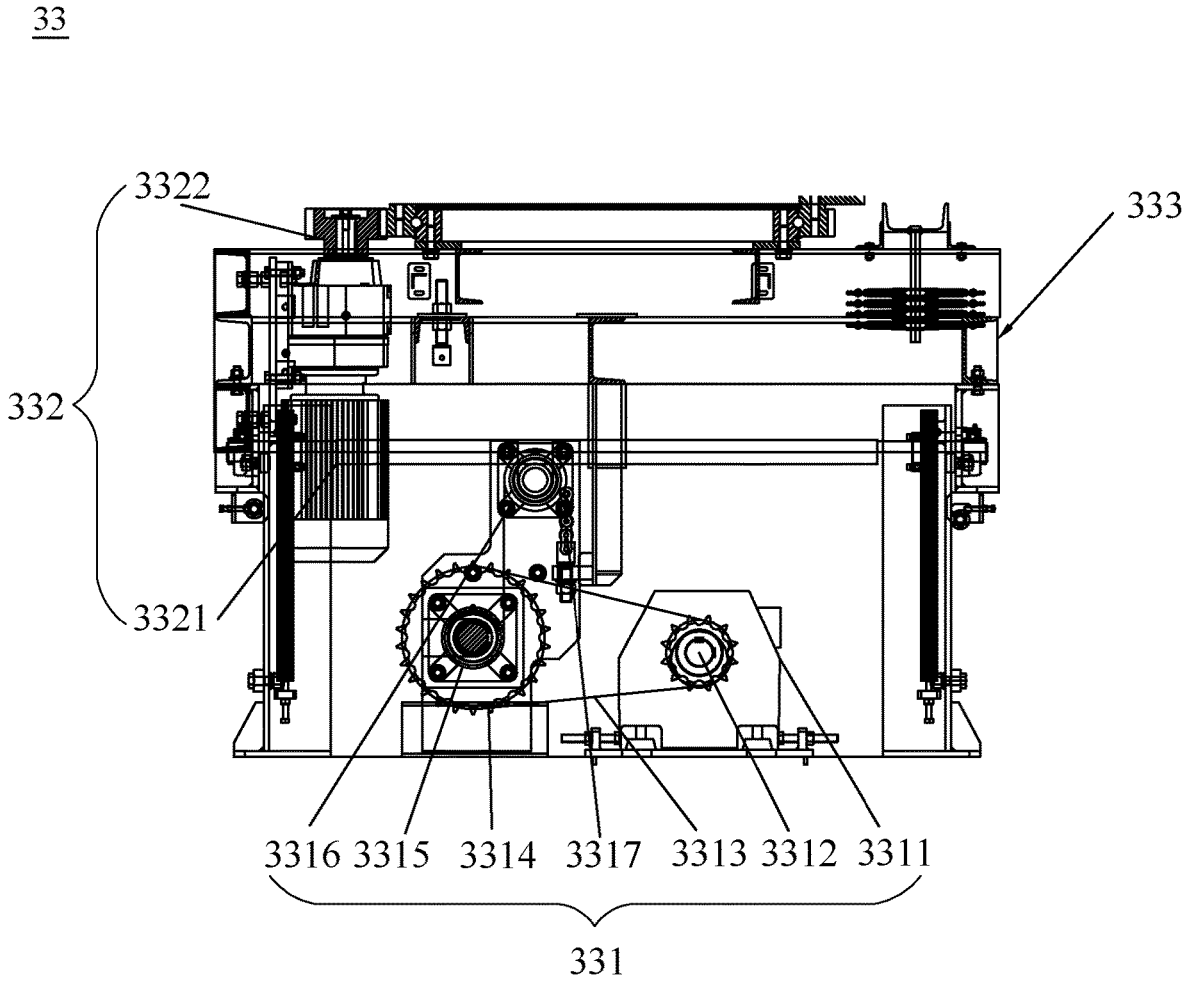
FIG. 3 is a front view of a rotating and jacking assembly according to an embodiment of the present invention.

As shown in FIG. 3, the rotating and jacking assembly 33 includes a jacking mechanism 331, a rotating mechanism 332 and a jacking frame 333, the jacking frame 333 is configured to support the loading board 9 thereon, the jacking mechanism 331 is connected with the jacking frame 333 so as to make the jacking frame 333 move up and down, and the rotating mechanism 332 is connected with the jacking frame 333 for making the jacking frame 333 rotate, then the loading board 9 disposed on the jacking frame 333 can rotate together with the jacking frame 333.

The jacking mechanism 331 includes a first motor 3311, a first driving wheel 3312 connected with an output end of the first motor 3311, a first driven wheel 3314 connected with the first driving wheel 3312 by a first chain 3313, a pulling wheel 3315 disposed coaxially with the first driven wheel 3314, a transmission wheel 3316 disposed above the pulling wheel 3315, and a second chain 3317 disposed on the pulling wheel 3315 and the transmission wheel 3316, the transmission wheel 3316 and the pulling wheel 3315 are staggered and tangent in a vertical direction, the second chain 3317 is extended vertically upwards from the pulling wheel 3315 and then is disposed on the transmission wheel 3316, a distal end of the second chain 3317 extended vertically downwards from the transmission wheel 3316 is connected with the jacking frame 333 for making the jacking frame 333 move up and down.

The rotating mechanism 332 includes a second motor 3321 and a horizontally rotating wheel 3322 connected with an output end of the second motor 3321, the horizontally rotating wheel 3322 is capable of being driven by the second motor 3321 so as to drive the jacking frame 333 to rotate.

Figure 6:
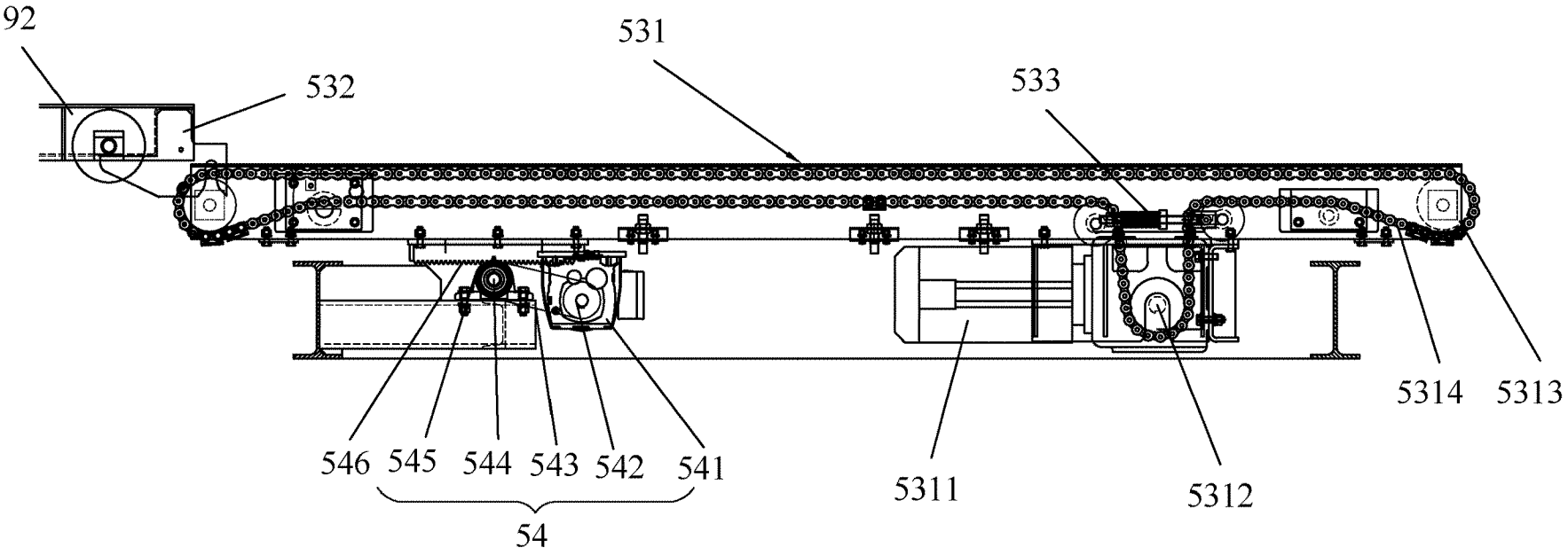
FIG. 6 shows a carrying device and a loading board being locked together, according to an embodiment of the present invention.
Figure 7:
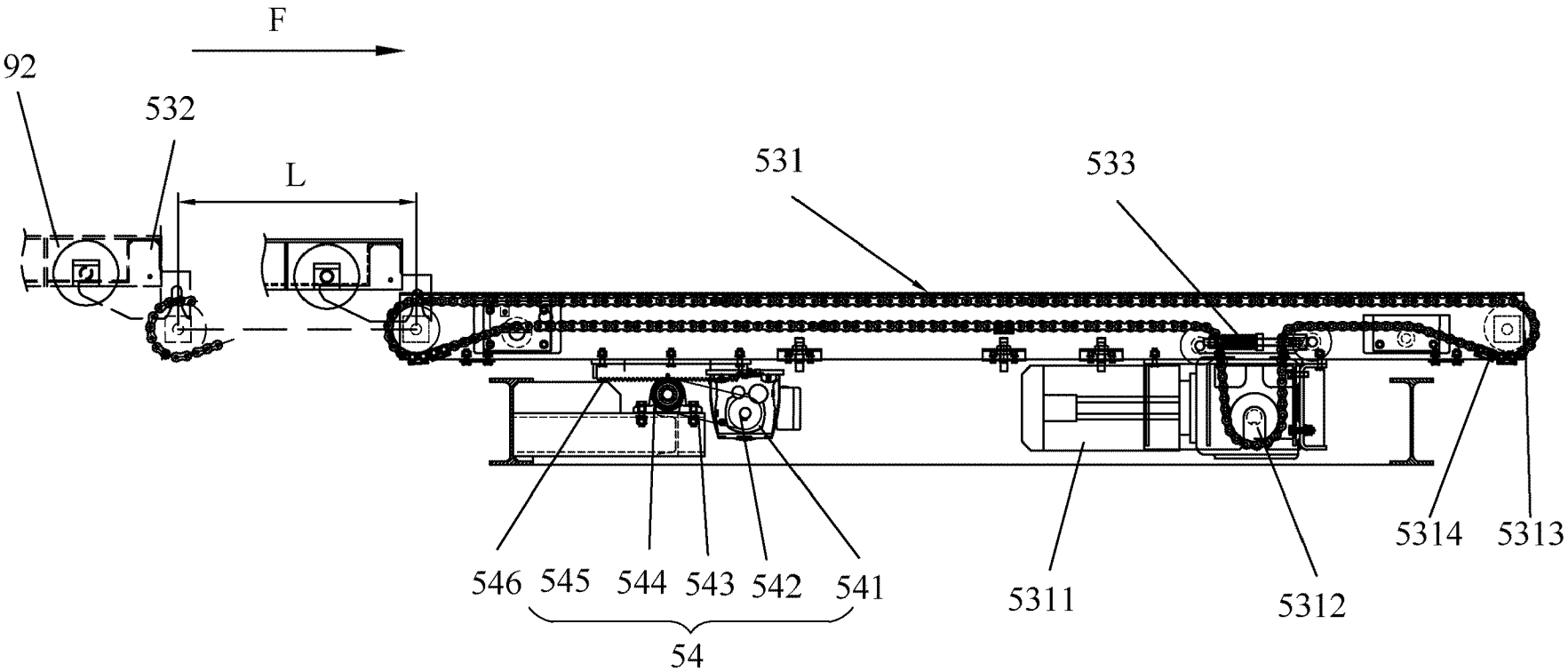
FIG. 7 shows a carrying device and a loading board being locked together and a micro-motion mechanism having a moving distance L along the direction of the arrow F.

Referring FIGS. 4, 6 and 7, the longitudinal pickup mechanism 53 includes two chain transmission devices 531 disposed at two opposite sides of the carrying frame 51, respectively, and a locking element 532 with two ends thereof fixed to the two chain transmission devices 531, respectively, the loading board 9 has a locking portion 92 for engaging with the locking element 532 disposed thereon, the locking portion 92 and the locking element 532 are configured to engage with each other so as to make the loading board 9 be locked with the longitudinal pickup mechanism 53, the locking portion 92 is a hook plate, the locking element 532 is a hanging rod, the hanging rod 532 is driven by the two chain transmission devices 531 so as to make the hook plate 92 move together, each chain transmission device 531 includes a third motor 5311, a second driving wheel 5312, a second driven wheel assembly 5313 and a third chain 5314, an output end of the third motor 5311 is connected with the second driving wheel 5312, the second driving wheel 5312 is connected with the second driven wheel assembly 5313 by the third chain 5314 so as to drive the loading board 9 locked with the hanging rod 532. In this embodiment, the loading board 9 and the longitudinal pickup mechanism 53 are fixed together by the engagement of the hanging rod 532 and the hook plate 92, however, the locking element 532 and the locking portion 92 are not limited to this embodiment, provided the loading board 9 and the longitudinal pickup mechanism 53 can be combined and released securely, the locking element 532 and the locking portion 92 may be various forms, for example, the locking element 532 and the locking portion 92 may be respectively defined as a male buckle and a female buckle. In this embodiment, the number of the hanging rods 532 is two, which should not be a limitation.

Preferably, the chain transmission device 531 has a tensioning structure 533, the second driven wheel assembly 5313 includes four driven wheels, two of the four driven wheels are disposed at two longitudinal ends of the third chain 5314, the other two of the four driven wheels are disposed between the two driven wheels at the two longitudinal ends of the third chain 5314 and are staggered with the two driven wheels at the two longitudinal ends of the third chain 5314 in the vertical direction, the second driving wheel 5312 is located between the other two of the four driven wheels in the longitudinal direction and is spaced from the other two of the four driven wheels in the vertical direction, the third chain 5314 is around on the second driving wheel 5312 and the two driven wheels at the two longitudinal ends of the third chain 5314, the other two of the four driven wheels are disposed to an outside of the third chain 5314, the tensioning structure 533 is disposed between the other two of the four driven wheels in order to adjust the tensioning degree of the third chain 5314. In this embodiment, the tensioning structure 533 is a chain tensioning regulator, which should not be a limitation.

Preferably, the carrying device 5 further includes a micro-motion mechanism 54 disposed on the carrying frame 51, the micro-motion mechanism 54 includes a fourth motor 541, a third driving wheel 542 connected with an output end of the fourth motor 541, a third driven wheel 544 connected with the third driving wheel 542 by a fourth chain 543, a gear 545 disposed coaxially with the third driven wheel 544, and a rack 546 longitudinally fixed on the longitudinal pickup mechanism 53 and engaging with the gear 545.

Referring FIG. 4, preferably, the transverse moving mechanism 52 includes a transverse driving motor 521, a driving rod 522 connected with an output end of the transverse driving motor 521, and two transverse moving wheels 523 disposed on two ends of the driving rod 522, the transverse driving motor 521 drives the driving rod 522 to rotate so as to make the two transverse moving wheels 523 roll.

In this embodiment, in order to prevent the loading board 9 from deviation during the movement, the carrying device 5 disposes two tracks 55 for the loading board 9 adjacent to the longitudinal pickup mechanism 53, which should not be a limitation.

Preferably, the transverse passage 11 forms a track 111, in this embodiment, the number of the tracks 111 is two, corresponding to the two transverse moving wheels 523 of the carrying device 5, therefore, the carrying device 5 can move stably along the tracks 111.

Preferably, the transverse passage 11 disposes a sliding contact wire (not shown), which make the carrying device 5 capable of getting a power supply while sliding in the transverse passage 11, therefore, it is not necessary to move the carrying device 5 out of the automatic parking system to be charged.

The vehicle parking process and the vehicle unparking process of the automatic parking system 100 according to this specific embodiment of the present invention is described below.

When the vehicle is parked, the carrying device 5 gets a loading board 9 and moves the loading board 9 onto the lifting platform 31, the hoisting mechanism 32 drives the lifting platform 31 with the carrying device 5 thereon to move up or down to the parking level 1 where the gateway 4 is disposed. Then the leveling mechanism is controlled to start working and the automatic door is opened, and then the vehicle 91 can be driven onto the loading board 9 on the carrying device 5. When the vehicle 91 is located on the carrying device 5, the hook plate 92 of the loading board 9 and the hanging rod 532 of the longitudinal pickup mechanism 53 are locked together, the automatic door is closed. Then the lifting device 3 together with the carrying device 5, the loading board 9 and the vehicle 91 are driven to a height corresponding to a target parking level 1. Then the transverse moving mechanism 52 drives the carrying device 5 to move to the corresponding transverse passage 11. When the carrying device 5 moves to a position corresponding to a target parking space 12 along the transverse passage 11, the micro-motion mechanism 54 drives the longitudinal pickup mechanism 53 to approach the corresponding parking space 12 in the direction opposite to the direction "F", the chain transmission device 531 disposed at the longitudinal pickup mechanism 53 drives the loading board 9 with the vehicle 91 thereon to move into the corresponding parking space 12, then, the hook plate 92 of loading board 9 and the hanging rod 532 of the longitudinal pickup mechanism 53 are disengaged with each other, at this time, the vehicle parking is completed.

When the vehicle is unparked, the transverse moving mechanism 52 drives the carrying device 5 to move to the position corresponding to the target parking space 12 along the transverse passage 11. Then the micro-motion mechanism 54 drives the longitudinal pickup mechanism 53 to approach the target parking space 12 in the direction "F" in order to make the hook plate 92 of the loading board 9 and the hanging rod 532 of the longitudinal pickup mechanism 53 are locked together. Then the third motor 5311 drives the third chain 5314 so as to make the loading board 9 locked with the hanging rod 532 move onto the carrying device 5. Then the transverse moving mechanism 52 drives the carrying device 5 to move onto the lifting platform 31, the hoisting mechanism 32 drives the lifting platform 31 to the parking level 1 where the gateway 4 is disposed, the jacking mechanism 331 makes the loading board 9 move upward, the hook plate 92 of the loading board 9 disengages with the hanging rod 532, the rotating mechanism 332 makes the loading board 9 rotate 180 degrees to turn the vehicle 91 around. Then the jacking mechanism 331 makes the loading board 9 move downward, the hook plate 92 and the hanging rod 532 are locked together again, then the automatic door is opened, the vehicle 91 can be driven forward out of the automatic parking system 100 from the gateway 4.

The automatic parking system with transverse arrangement 100 of the present invention uses the lifting device 3 to drive the carrying device 5 to move up and down, the transverse moving mechanism 52 of the carrying device 5 is configured to drive the carrying device 5 to move back and forth in any transverse passage 11 of the automatic parking system with transverse arrangement 100, therefore, the carrying device 5 of the present invention can store or get the vehicle 91 at different parking levels 1, then has good fault tolerance, high flexibility and high efficiency. Moreover, the two ends of all transverse passages 11 are connected with the respective lifting tunnels 2, the two lifting tunnels 2 form two gateways 4, respectively, then the vehicle 91 can be driven forward into the automatic parking system 100 from one of the gateways 4 and be driven forward out of the automatic parking system 100 from the other of the gateways 4. It does not require the user back the vehicle 91, therefore the user can park and unpark the vehicle 91 convenient and fast, the problems caused by driving technology or other reasons are greatly reduced. In addition, the rotating and jacking assembly 33 can turn the vehicle 91 around, therefore, the automatic parking system 100 can make the user do not need to back the vehicle 91 by just one lifting tunnel 2 with the gateway 4.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An automatic parking system with transverse arrangement, comprising:

at least two parking levels, each parking level comprising a transverse passage and a transverse row of parking spaces connected to at least one side of the transverse passage;

at least one lifting tunnel connected to at least one of two ends of the transverse passages of the at least two parking levels;

a gateway formed in an outer side of the at least one lifting tunnel;

at least two carrying devices for carrying vehicles, each carrying device comprising a carrying frame and a transverse moving mechanism adapted for driving the carrying device to move along the transverse passage; and a lifting device disposed in the at least one lifting tunnel for conveying the carrying device to a height corresponding to any of the parking levels;

wherein the carrying device further comprises a longitudinal pickup mechanism for moving a loading board configured to support a vehicle thereon between the corresponding parking spaces and the carrying frame; the lifting device comprises a lifting platform and a rotating and jacking assembly disposed on the lifting platform, the rotating and jacking assembly is configured to be connected with a bottom of the loading board so as to make the loading board rotate and move up and down; the rotating and jacking assembly comprises a jacking mechanism, a rotating mechanism and a jacking frame, the jacking frame is configured to support the loading board thereon, the jacking mechanism is connected with the jacking frame so as to make the jacking frame move up and down, and the rotating mechanism is connected with the jacking frame for making the jacking frame rotate.

2. The automatic parking system with transverse arrangement according to claim 1, wherein the two ends of the transverse passages of the at least two parking levels are connected with two lifting tunnels, respectively; and two gateways are formed in the outer sides of the two lifting tunnels, respectively.

3. The automatic parking system with transverse arrangement according to claim 1, wherein the jacking mechanism comprises a first motor, a first driving wheel connected with an output end of the first motor, a first driven wheel connected with the first driving wheel by a first chain, a pulling wheel disposed coaxially with the first driven wheel, a transmission wheel disposed above the pulling wheel, and a second chain disposed on the pulling wheel and the transmission wheel, the transmission wheel and the pulling wheel are staggered and tangent in a vertical direction, the second chain is extended vertically upwards from the pulling wheel and then is disposed on the transmission wheel, a distal end of the second chain extended vertically downwards from the transmission wheel is connected with the jacking frame for making the jacking frame move up and down.

4. The automatic parking system with transverse arrangement according to claim 1, wherein the rotating mechanism comprises a second motor and a horizontally rotating wheel connected with an output end of the second motor, the horizontally rotating wheel is capable of being driven by the second motor so as to drive the jacking frame to rotate.

5. The automatic parking system with transverse arrangement according to claim 1, wherein the longitudinal pickup mechanism comprises two chain transmission devices disposed at two opposite sides of the carrying frame, respectively, and a locking element with two ends thereof fixed to the two chain transmission devices, respectively, the loading board has a locking portion for engaging with the locking element disposed thereon, the locking portion and the locking element are configured to engage with each other so as to make the loading board be locked with the longitudinal pickup mechanism, the locking portion is a hook plate, the locking element is a hanging rod, the hanging rod is driven by the two chain transmission devices so as to make the hook plate move together, each chain transmission device comprises a third motor, a second driving wheel, a second driven wheel assembly and a third chain, an output end of the third motor is connected with the second driving wheel, the second driving wheel is connected with the second driven wheel assembly by the third chain so as to drive the loading board locked with the hanging rod.

6. The automatic parking system with transverse arrangement according to claim 1, wherein the carrying device further comprises a micro-motion mechanism disposed on the carrying frame, the micro-motion mechanism comprises a fourth motor, a third driving wheel connected with an output end of the fourth motor, a third driven wheel connected with the third driving wheel by a fourth chain, a gear disposed coaxially with the third driven wheel, and a rack longitudinally fixed on the longitudinal pickup mechanism and engaging with the gear.

7. The automatic parking system with transverse arrangement according to claim 1, wherein the transverse moving mechanism comprises a transverse driving motor, a driving rod connected with an output end of the transverse driving motor, and two transverse moving wheels disposed on two ends of the driving rod, the transverse driving motor drives the driving rod to rotate so as to make the two transverse moving wheels roll.

8. An automatic parking system with transverse arrangement, comprising:

at least two parking levels, each parking level comprising a transverse passage and a transverse row of parking spaces connected to at least one side of the transverse passage;

at least one lifting tunnel connected to at least one of two ends of the transverse passages of the at least two parking levels;

a gateway formed in an outer side of the at least one lifting tunnel;

at least two carrying devices for carrying vehicles, each carrying device comprising a carrying frame and a transverse moving mechanism adapted for driving the carrying device to move along the transverse passage; and a lifting device disposed in the at least one lifting tunnel for conveying the carrying device to a height corresponding to any of the parking levels;

wherein the carrying device further comprises a longitudinal pickup mechanism for moving a loading board configured to support a vehicle thereon between the corresponding parking spaces and the carrying frame;

wherein the longitudinal pickup mechanism comprises two chain transmission devices disposed at two opposite sides of the carrying frame, respectively, and a locking element with two ends thereof fixed to the two chain transmission devices, respectively, the loading board has a locking portion for engaging with the locking element disposed thereon, the locking portion and the locking element are configured to engage with each other so as to make the loading board be locked with the longitudinal pickup mechanism, the locking portion is a hook plate, the locking element is a hanging rod, the hanging rod is driven by the two chain transmission devices so as to make the hook plate move together, each chain transmission device comprises a third motor, a second driving wheel, a second driven wheel assembly and a third chain, an output end of the third motor is connected with the second driving wheel, the second driving wheel is connected with the second driven wheel assembly by the third chain so as to drive the loading board locked with the hanging rod.

9. The automatic parking system with transverse arrangement according to claim 1, wherein the two ends of the transverse passages of the at least two parking levels are connected with two lifting tunnels, respectively; and two gateways are formed in the outer sides of the two lifting tunnels, respectively.

* * * * *